United States Patent [19]

Kanda et al.

[11] Patent Number: 4,924,966

[45] Date of Patent: May 15, 1990

[54] MUFFLER

[75] Inventors: Tetsuro Kanda, Yokohama; Shizuo Yamamoto, Kawasaki, both of Japan

[73] Assignee: Chiyoda Chemical Engineering & Construction Company Limited, Kanagawa, Japan

[21] Appl. No.: 81,722

[22] Filed: Aug. 5, 1987

[30] Foreign Application Priority Data

Aug. 20, 1986 [JP] Japan ..... 61-192853

[51] Int. Cl.[5] ..... F01N 1/06; F01N 1/24; F01N 7/08

[52] U.S. Cl. ..... 181/228; 181/255; 181/257; 181/264; 181/268; 181/272

[58] Field of Search ..... 181/228, 247–252, 181/257, 264, 268, 272, 275, 255

[56] References Cited

U.S. PATENT DOCUMENTS

| | | | |
|---|---|---|---|
| 1,591,088 | 7/1926 | Holmes | 181/251 |
| 1,810,252 | 6/1931 | Noonan | 181/264 |
| 2,027,359 | 1/1936 | Wood et al. | 181/264 |
| 2,041,767 | 5/1936 | Jack 3d | 181/248 |
| 2,938,593 | 5/1960 | Miller et al. | 181/275 |
| 3,071,160 | 1/1963 | Weichbrod | 181/247 X |
| 3,323,613 | 6/1967 | Hanchett | 181/250 |
| 3,396,812 | 8/1968 | Wilcore et al. | 181/250 |
| 4,600,076 | 7/1986 | Yamamoto et al. | 181/268 X |

FOREIGN PATENT DOCUMENTS

| | | | |
|---|---|---|---|
| 795628 | 3/1936 | France | 181/264 |
| 831846 | 9/1938 | France | 181/264 |

*Primary Examiner*—B. R. Fuller

*Attorney, Agent, or Firm*—Oblon, Spivak, McClelland, Maier & Neustadt

[57] ABSTRACT

A muffler has a muffler body within which is located an intermediate duct pipe colinear with the exhaust and tail pipes, so that exhaust gas from the exhaust duct pipe can pass through a main flow route in the intermediate duct pipe in a substantially straight line without reflecting. An inner or by-pass pipe forms a gas by-pass and has gas flow restriction elements.

4 Claims, 12 Drawing Sheets

MUFFLER

FIELD OF THE INVENTION

This invention relates to a muffler which muffles exhaust sound generated from automobile engines, etc., and more particularly, a muffler having small resistance to the flow of exhaust gas, and has very efficient sound muffling ability.

BACKGROUND OF THE INVENTION

Many types of mufflers to muffle the exhaust sound generated from automobile engines, etc., have been used, and among those existing types, a representative type is indicated in FIG. 20, which is constructed to have for example a cylindrical muffler body to which one end is attached to an exhaust duct pipe 1' which is connected to the exhaust port of the engine at the other end, a tail pipe 2' is attached to the other end, to have their positions displacing each other, the muffler body is divided into plural number of chambers 5*a*, 5*b*, 5*c*, with bulkheads 4, 4, attaching exhaust duct pipe 1' to the end so that the duct pipe penetrates through the both bulkheads 4, 4 and opens to the chamber 5*c*, attach a tail pipe 2 to the other end so that it is staggered with the exhaust duct pipe 1' and to open in the chamber 5*a*, places two intermediate ducts 6, 6' to pass through the bulkheads 4, 4 so that these chambers 5*a*, 5*b*, 5*c* are connected, provides many small holes 7 around the wall of the aforementioned exhaust duct pipe 1' at the portion within the body, to muffle the sound by the resistance when the exhaust gas passing these small holes 7, resistance during the gas reflect its direction, and the capacities of chambers 5*a*, 5*b*, 5*c*.

It is desirable to reduce the exhaust resistance be as small as possible for an exhaust system to upraise the efficiency of the engine, however, there are problems that exhaust system generates resonance under small exhaust resistance, and an exhaust sound of specific frequency cannot be muffled.

So far exhaust resistance was increased by passing the exhaust gas through many small holes 7, or make the gas flow reflected to prevent the resonance phenomena as shown in FIG. 20, however, increase of the exhaust resistance accompanies efficiency reduction of the engine, and the results is not satisfactory.

The resonance phenomenon are a phenomenon that a progressing wave which is a sound wave generated in an engine traveled through the exhaust duct, muffler body, tail pipe reflects at the end of the tail pipe, becomes a reflected wave and interferes with the progressive wave, and intensifies the sound, or a phenomenon to accumulate the sound energy.

Therefore, prevention of the resonance phenomenon can be effected by preventing energy accumulation by absorbing the sound energy at some place of the exhaust duct muffler body, tailpipe, however, absorption of energy by installing resistance in the main stream of the exhaust gas such as the exhaust duct, muffler and tail pipe will increase the exhaust resistance and is not preferable, therefore this should be avoided.

SUMMARY OF THE INVENTION

The present invention stands on a quite different principle from the muffler of the prior art, and has the object to muffle exhaust sound effectively by preventing resonance without increasing exhaust resistance.

The other object of the invention is to offer a muffler with simple structure, with less chance of generating failure, and having excellent durability.

Further object of this invention is to offer a muffler which is helpful for the economy of energy and prevention of noise pollution.

The present invention reduces exhaust resistance by flowing the gas flow almost in a straight line without reflecting in the body of the muffler, on the other hand, an inner pipe having an plural number of resistance bodies through which gas can pass are provided to the inside of the exhaust duct, intermediate duct and tail pipe, or a by-pass way is also provided to branch the flow from the exhaust duct or upper stream side of the tail pipe, and also provides resistance body in the by-pass to diverge the exhaust gas sent from the engine through the exhaust duct pipe into the main flow route and the by-pass flow route, make a part of the progressive wave and a part of the reflected wave reflected at the end of the tail pipe to transfer into the by-pass route, and have this by-pass flow route absorb the sound wave energy, and to prevent accumulation of sound energy and accompanied generation of resonance phenomenon, and muffle the exhaust sound generated by the engine.

BRIEF DESCRIPTION OF THE DRAWINGS

Moreover.

DETAILED DESCRIPTION OF THE INVENTION

Figure 1:
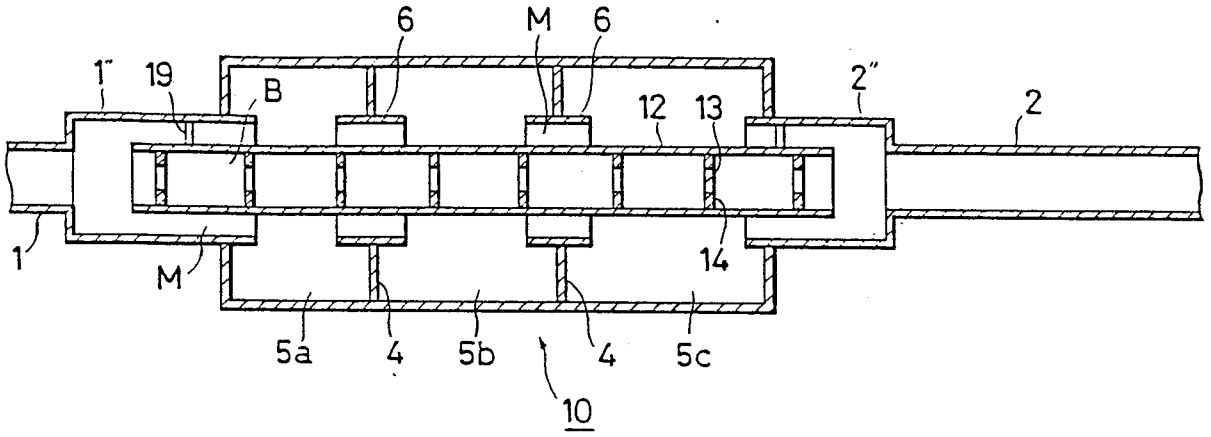
FIG. 1 is a longitudinal sectional elevation of the muffler of an exemplary embodiment of the present invention.

FIG. 1 indicates the first exemplary embodiment of the present invention, and the tail pipe 2 is attached to the other end of the muffler body 10 having exhaust duct pipe 1 attached to an end. Moreover, the exhaust duct pipe 1 attached has its large diameter part 1" to the muffler body 10 side, and the muffler body side of the tail pipe 2 has also a large diameter part 2".

Figure 2:
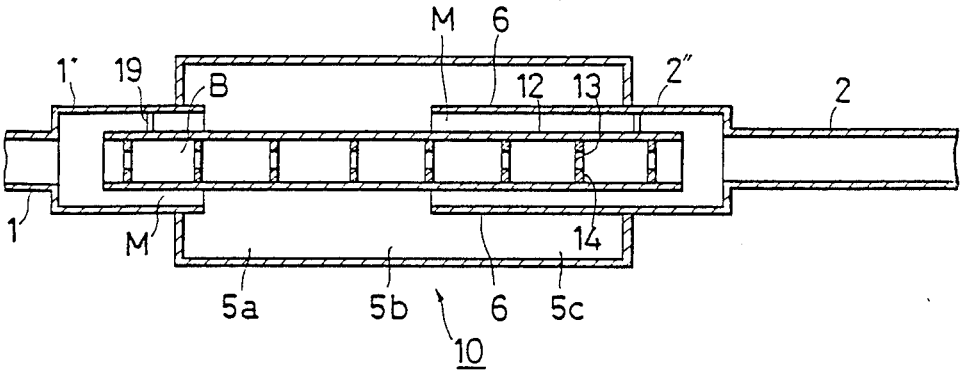
FIG. 2 is longitudinal sectional side view of another exemplary embodiment of this invention.
Figure 3:
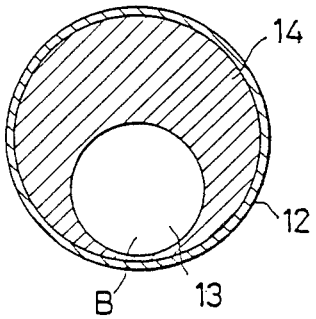
FIG. 3 is a traverse sectional view of the second exemplary embodiment.

The muffler body 10 is separated to plural number of chambers 5a, 5b, 5c with the plural number of bulkheads 4, 4, and these chambers 5a, 5b, 5c are connected by intermediate duct pipes 6, 6 which pass through the center of the bulkheads 4, 4 colinear with the exhaust duct pipe 1. The muffler body 10 of the first exemplary embodiment is separated into plural number of chambers 5a, 5b, 5c, however, it is not necessary to be separated into plural number of chambers, but it may be constructed to have intermediate duct pipe 6 connected to the large diameter part 2" of the tail pipe 2 as shown in FIG. 2.

On the other hand, the inner pipe 12 is installed to the interior of the large diameter part 1" of the exhaust duct pipe 1, the intermediate duct pipe 6 and the large diameter part 2" of the tail pipe 2, to be a double pipe structure, and the aforementioned inner pipe 12 is supported to the large diameter parts 1" and 2" by means of the supporting pieces 19, 19,—and the main flow route M is formed between the intermediate duct pipe 6 and the inside circumferencial wall of the tail pipe 2 without any resistance body.

On the other hand, to the inside of the inner pipe 12 several resistance bodies 14, each having a passing hole 13 at the center to form an orifice, are attached at a certain interval, forming the by-pass flow route B.

It is effective to form 5 to 20 orifices in this resistance body 14, and the opening ratio of the passing holes 13 is preferably 20% to 70% of the sectional area of the resistance bodies 14, the opening ratio less than that is not desirable because the sound wave is reflected by the resistance body 14 and the orifice does not perform absorption of sound wave energy, and more resistance bodies 14 are necessary to obtain the required resistance with the larger opening ratio, and is uneconomical.

Further, the resistance body 14 is not necessarily to be an orifice, but it may also be a perforated plate, spiral plate, metal mesh, wire-like body, or filament sound absorber such as glass wool.

The sectional area of the inner pipe 12 forming the said by-pass flow route is desirable to be the same order with the sectional area of the tail pipe 2, and the length of the inner pipe 12 is desirable to be ¼ or more of the wave length of the sound wave, however, the effect is obtainable at the length of 1/16 or about.

However, the effect will be lost with the shorter length, therefore, at least three times of the diameter of the tail pipe 2 is desirable.

Moreover, it is important that the main flow route M and by-pass flow route B are separated except at the diverging point and converging point, and there shall be no transfer of sound wave energy between the routes, and perforation of the wall of the inner pipe 12 shall be avoided.

Further, for the case of dusts mingled in the exhaust gas as in the case of a diesel engine, the passing hole 13' to be provided in the resistance body 14 is desirable to be installed lower so that it will contact with the inside wall of the inner pipe 12 to prevent the deposit of dust to the inside of inner pipe 12.

Figure 4:
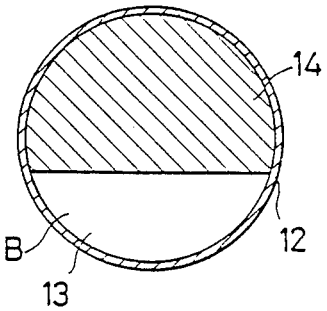
FIG. 4 is a traverse sectional view of the third exemplary embodiment.

Moreover, the configuration of the passing holes 13, 13' of this resistance body is not restricted to a circular form, but it may be a semi-circular as the third exemplary embodiment shown in FIG. 4, or any other forms can be adopted.

In each of the aforementioned exemplary embodiments, exhaust gas conducted through the exhaust duct pipe 1 passes through the main flow route M between the exhaust duct pipe 1 and inner pipe 12, between the intermediate duct pipe 6 and inner pipe 12, and between the tail pipe 2 and inner pipe 12, during this the flow passes the plural number of chambers 5a, 5b, 5c seccessively, and exhausted to outside from the tail pipe 2.

A part of the exhaust gas is conducted from the exhaust duct pipe 1 to the by-pass flow route B in the inner pipe 2, passes through the passing hole 13 of each resistance body 14 and is exhausted to outside from the tail pipe 2, however, this quantity is small in comparison with the gas flow passing the main flow route M, because there is no resistance in the main flow route M, where large part of the gas flows, and the exhaust resistance is very small.

During the exhaust gas passing through the interior of the muffler body 10, or plural number of chambers in it, the sound wave of the exhaust gas is damped.

Generally, resonance phenomena generate when the gas flow is not reflected in the muffler body 10 and the exhaust resistance is small and the sound wave is not damped, however, in the muffler of this invention, the resistance body 14 provided in the inner pipe 12 acts as the resistance to the sound wave, and the resonance phenomenon is suppressed.

Figure 5:
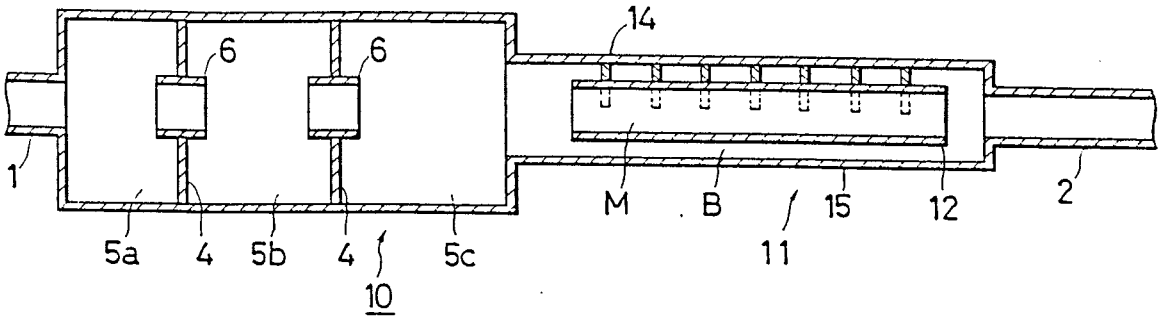
FIG. 5 is a longitudinal sectional side view of the fourth exemplary embodiment of this invention.
Figure 6:
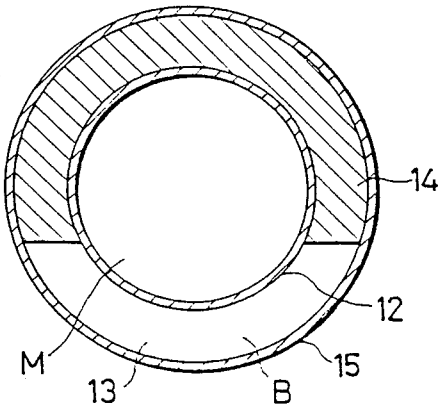
FIG. 6 is a traverse sectional view of the major part of FIG. 5.

Nextly, FIG. 5 and FIG. 6 indicate the fourth exemplary embodiment of this invention, which has a muffler body 10 having the exhaust duct pipe 1 to one end, and is constructed with resonance prevention body 11 having main flow route M and by-pass flow route B to the other side, and the tail pipe 2 is attached to the end of this resonance prevention body 11.

The muffler body 10 is separated to the plural number of chambers 5a, 5b, 5c by plural number of bulkheads 4, 4, and these chambers 5a, 5b, 5c are connected through with short intermediate duct pipes 6, 6 which pass the bulkheads 4, 4 on the same line with exhaust duct pipe 1. In this case, division to chambers is not the necessary condition.

On the other hand, the resonance prevention body 11, which is connected to the muffler body 10, is made to a double pipe structure with outer pipe 15 and inner pipe 12, and circular arc shaped resistance bodies 14 are attached to the upper part of the space between the outer pipe 15 and inner pipe 12 at a certain intervals. The under part of the resistance body 14 forms the passage hole 13. Namely, in this exemplary embodiment, contrary to the first exemplary embodiment, the inner pipe 12 constitutes the main flow route M and the space between the inner pipe 12 and the outer pipe 15 is the by-pass flow route B.

Figure 7:
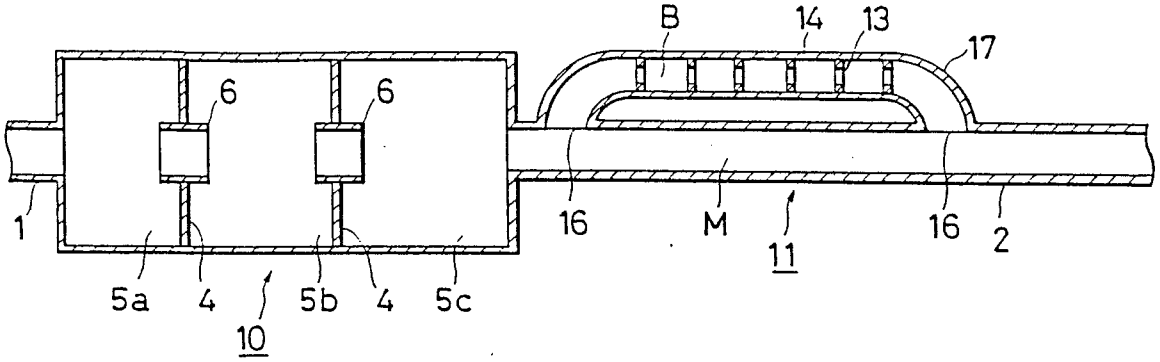
FIG. 7 is a longitudinal sectional elevation view of the fifth exemplary embodiment.

On the other hand, FIG. 7 indicates the fifth exemplary embodiment of the present invention, in this embodiment diverging holes 16, 16 are provided to the upper and lower stream sides of the tail pipe 2, and the diverging holes 16, 16 are connected with a branch pipe 17; plural number of resistance bodies 14, each having passage hole 13, are attached in this branch pipe 17 at a certain determined distance, and inside this branch pipe 17 is the by-pass flow route B, and inside the tail pipe 2 is the main flow route. Constitution of the other part of the muffler body 10 is the same as that of the fourth exemplary embodiment.

Figure 8:
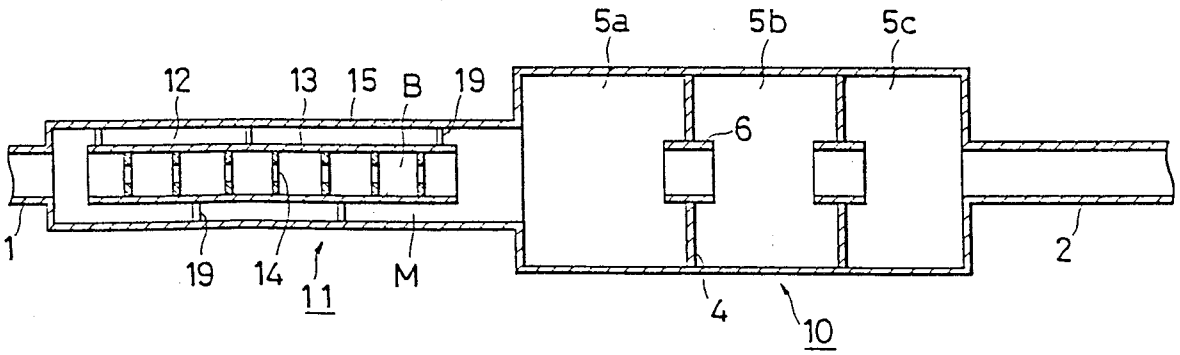
FIG. 8 is a longitudinal sectional elevation view of the sixth exemplary embodiment of this invention.

Moreover, FIG. 8 indicates the sixth exemplary embodiment of the present invention, in this embodiment a resonance prevention body 11 was prepared between the exhaust duct pipe 1 and the muffler body 10. The resonance prevention body 11 is constructed as a double pipe structure consisted of the outer pipe 15 and the inner pipe 12, and the inner pipe 12 is supported by the supporting pieces 19, 19 to the inside wall of the outer pipe 15 and are formed such that they do not form a resistance body, and the main flow route M is formed.

Structure of the inner tube 12 is the same with that of the first exemplary embodiment, therefore, the same symbols are assigned and the explanation is eliminated.

The structure of the muffler body 10 is the same as that of the first exemplary embodiment.

Further, it is possible to use the inside of the inner tube 12 as the main flow route M, and the space between the outer pipe 15 and the inner pipe 12 as the by-pass flow route B as in the case of the fourth exemplary embodiment, and a by-pass flow route B may be branched to the outside.

Figure 9:
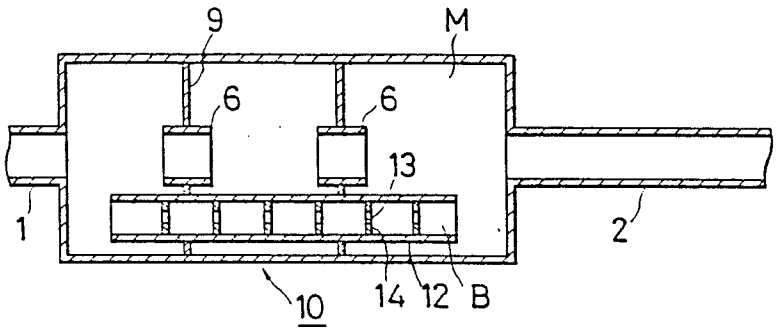
FIG. 9 is a longitudinal sectional elevation view of the seventh exemplary embodiment of this invention.

Moreover, it is possible to locate inner tube 12 through the bulkhead 4, 4 within the muffler body 10 as the seventh exemplary embodiment shown in FIG. 9, and attach several resistance bodies 14 having the passage hole 13 within the inner pipe 12 and make the inside of this pipe as the by-pass flow route B, and the space connected by the intermediate duct pipes 6, 6 as the main flow route M.

Figure 10:
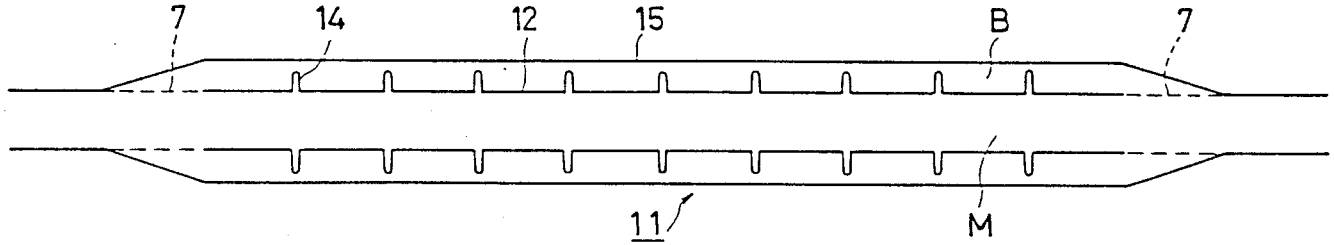
FIG. 10 is a longitudinal sectional elevation view of the eighth exemplary embodiment of this invention.

FIG. 10 indicates the eighth exemplary embodiment of this invention, and the resonance prevention body is the finny formed inner pipe 12 which is the by-pass flow route parallely installed to the resonance prevention body, or the exhaust duct tube or the tail pipe, and the finned body is serving as resistance body 14, and the inner pipe has small holes 7 at introducing side and exhaust side. The inner pipe 12 and the resistance body 14 of this exemplary embodiment can be made as one body and the manufacturing process is simple.

Further, the gas flow in the by-pass flow route B between the inner pipe 12 and outer pipe 15, is small because of the resistance body 14, there is an advantage that outer pipe 15 is not too hot.

Figure 11:
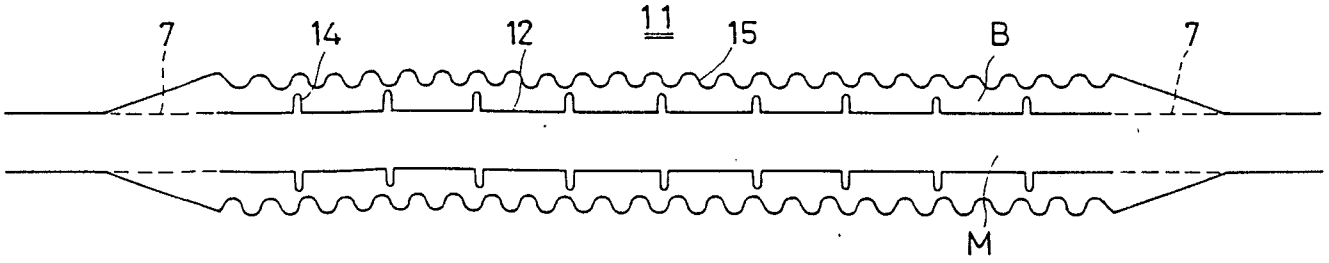
FIG. 11 is a longitudinal sectional view of the ninth exemplary embodiment of this invention.

Further, FIG. 11 shows the ninth exemplary embodiment of this invention, by which the inner pipe 12 is formed with waved fin and the outer pipe 15 is corrugated in wave form. In this example, both the inner tube 12 and outer tube 15 are flexible, and is advantageous that the engine vibration is not transferred to the muffler body.

Figure 12:
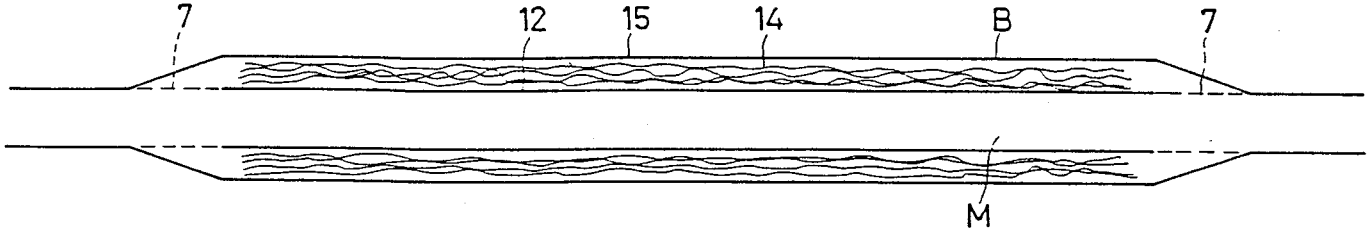
FIG. 12 is a longitudinal sectional view of the tenth exemplary embodiment of this invention.

Further, FIG. 12 shows the tenth exemplary embodiment of the present invention, which has a mesh or wire resistance body 14 between the inner tube 12 and outer tube 15 and has advantages of easiness to manufacture.

Figure 13:
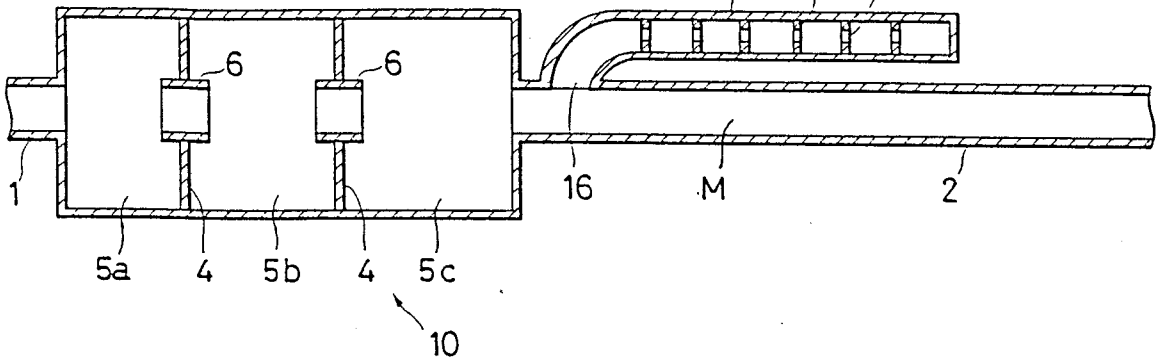
FIG. 13 is a longitudinal sectional view of the eleventh exemplary embodiment of this invention.

On the other hand, FIG. 13 indicates the eleventh exemplary embodiment of the present invention, in this embodiment a diverging hole 16 is provided to the up-stream side of the tail pipe 2, and the branch pipe 17 is connected to the diverging hole 16, and plural number of resistance bodies 14 each having a passage hole 13 are attached at a certain interval to the inside of the branch pipe 17, the end of the branch pipe 17 is blocked, and the inside of the tail pipe 2 is made as the main flow route M. Structure of the other parts of the muffler body 10 are the same with that of the fifth exemplary embodiment. Moreover, the resistance body may be perforated plates, spiral plates, metal meshes, line state bodies, or fiber state sound absorbing body such as glass wool as mentioned before.

The diverging hole 16 may be provided to the exhaust duct pipe 1. This exemplary embodiment is specially effective for the sound wave of long wave length.

Figure 14:
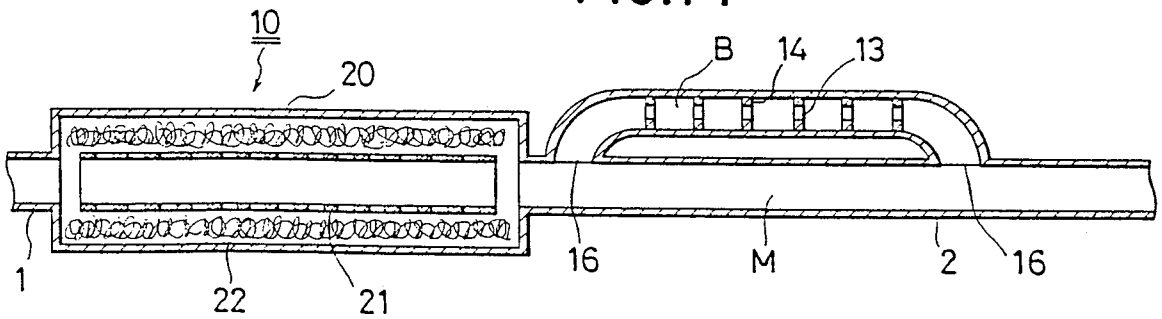
FIG. 14 is a longitudinal sectional view of the twelfth exemplary embodiment of this invention.

Further, FIG. 14 indicates the twelfth exemplary embodiment of the present invention.

This exemplary embodiment is the combination of the sound absorbing type muffler body and by-pass flow route, by which the muffler body 10 is formed with the outer pipe 20 of which one end is connected to the exhaust duct pipe 1, and other end is connected to the tail pipe 2, and consisted with intermediate duct pipe 21 having many holes and the space between the above outer pipe 20 and intermediate duct pipe 21 is stuffed with the sound absorbing material 22 such as glass wool. In this case, multi-holed intermediate duct pipe 21 can be connected with the exhaust duct pipe 1 and the tail pipe 2, to be formed as one body. Further, diverging holes 16, 16 are provided to the up-stream side and down-stream side of the tail pipe respectively and connect those diverging holes 16, 16 with a branch pipe 17, and plural number of resistance bodies 14 each having a passage hole 13 in the branch pipe 17 are attached at a certain interval, making this branch pipe 17 as the by-pass flow route B, and the tail pipe 2 as the main flow route M.

This exemplary embodiment is made to muffle both high and low frequency sounds by combining absorption type muffler, which is effective for the high frequency sound of 3 KHZ or higher but less effective for low frequency, and a by-pass flow route which is effective for low frequency sound waves.

Moreover, the by-pass flow route B may be made with the branch pipe 17 as the 12th exemplary embodiment shown in FIG. 13 and closing the end.

Figure 15:
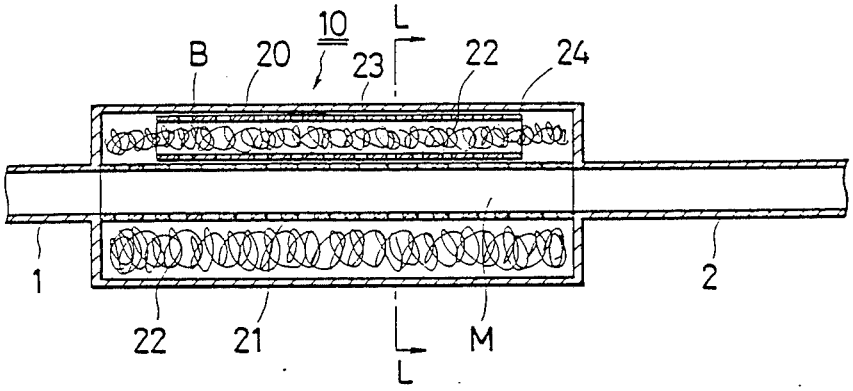
FIG. 15 is a longitudinal sectional view of the thirteenth exemplary embodiment of this invention.
Figure 16:
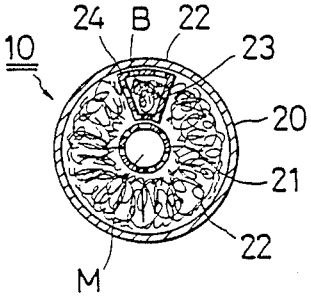
FIG. 16 is the sectional view of the FIG. 15 seen at L—L arrows.

Nextly, FIG. 15 and FIG. 16 indicate the thirteenth exemplary embodiment of the present invention having by-pass flow route positioned between the outer pipe of the sound absorption type muffler body and the intermediate duct pipe. The muffler body 10 consists of the outer pipe 20 and the perforated intermediate duct 21 having many through holes 23 to the circumferencial wall, and the by-pass flow route B consists of cylindrical body 24 is located in the space between the above outer pipe 20 and the intermediate duct pipe 21. Further, the space between the outer pipe 20 and the intermediate duct pipe 21, including the inside of the above by-pass flow route B is stuffed with sound absorbing material 22 such as glass wool. The intermediate duct pipe 21 may be formed as one body with the exhaust duct pipe and the tail pipe as in the case of twelfth exemplary embodiment.

Figure 17:
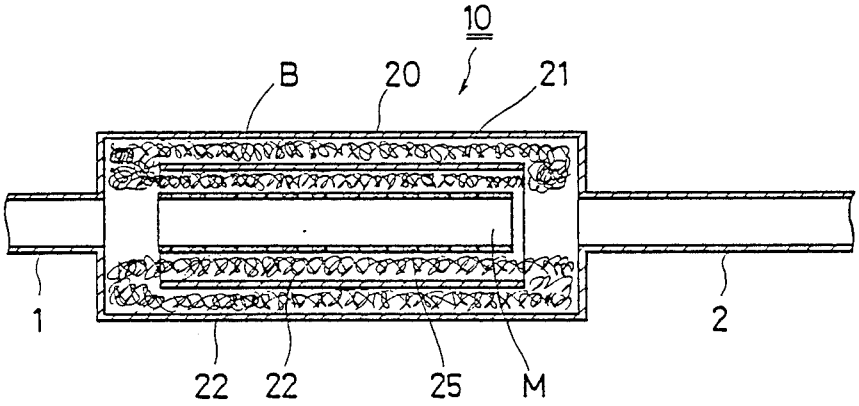
FIG. 17 is a longitudinal sectional view of the fourteenth exemplary embodiment of this invention.

Further, FIG. 17 indicates the fourteenth exemplary embodiment of the present invention, in which the muffler body 10 is made as a triple tube structure with the outer pipe 20, the perforated intermediate duct pipe 25, and the inner pipe 21 positioned at the middle point of the intermediate duct and outer pipes, and the space between the outer pipe 20 and the intermediate duct pipe 25 is stuffed with acoustic damping material 22 such as glass wool, to make the acoustic damping material 22 between the intermediate pipe 25 and inner pipe 21 absorb the high frequency sound wave, and to make the space between the outer pipe 20 and intermediate duct pipe 25 as by-pass flow route and muffle the low frequency sound.

Figure 18:
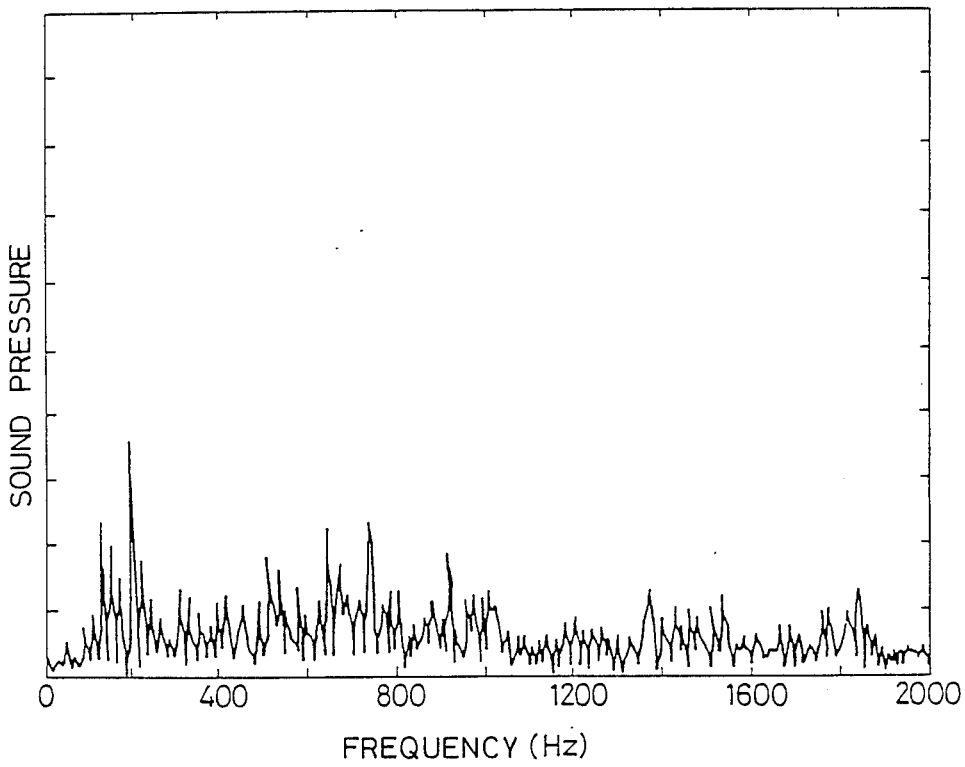
FIG. 18 is the sound pressure spectral diagram of the muffler related to the present invention.
Figure 19:
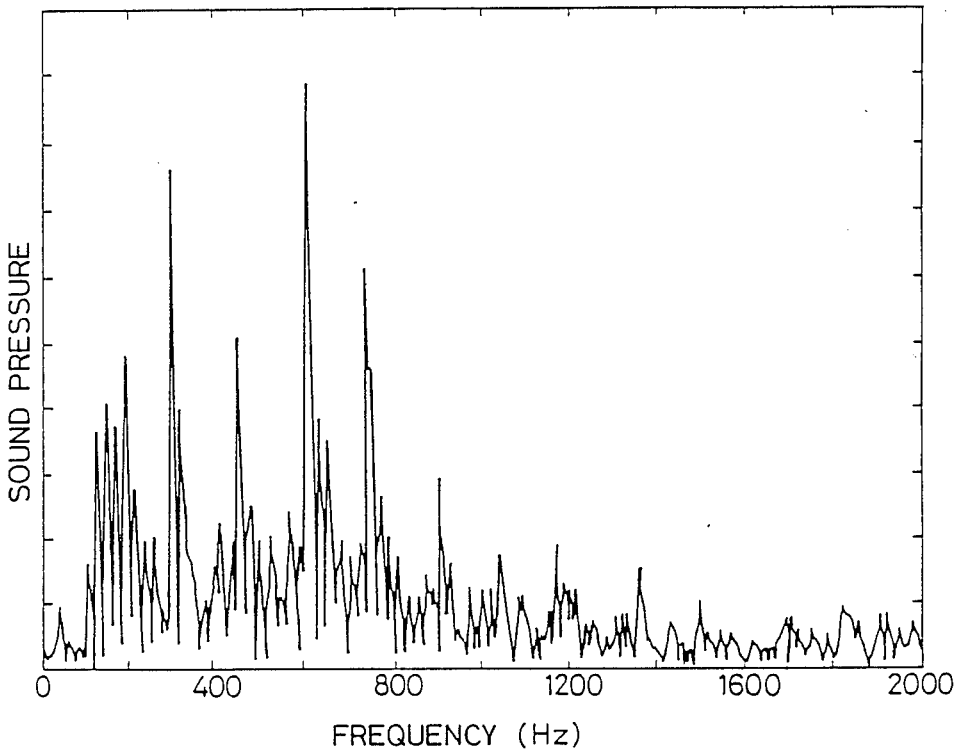
FIG. 19 is a sound pressure spectral diagram of a conventional muffler.
Figure 20:
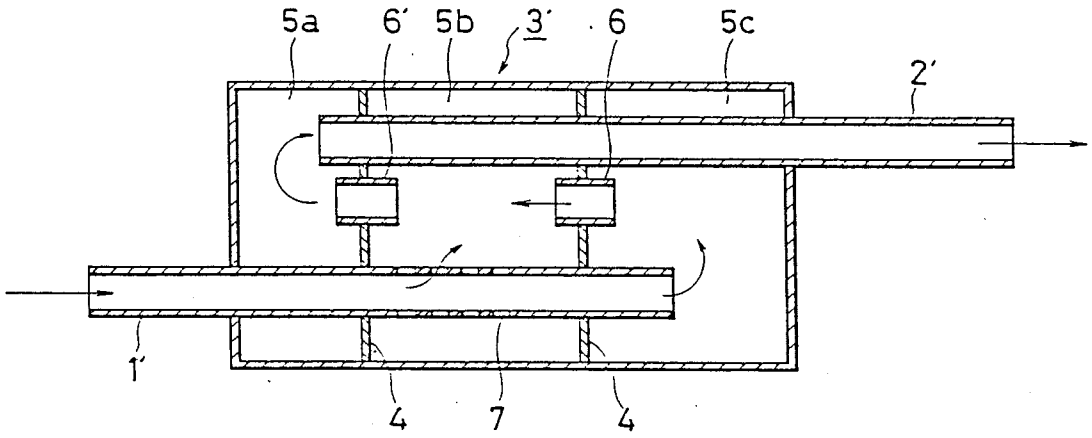
FIG. 20 is a longitudinal sectional elevation view of an example of the prior art muffler.

FIG. 18 and FIG. 19 are the sound pressure spectrodiagrams actually measured at the place of 45° angle and 30 cm apart from the end of the tail pipe. FIG. 19 is the measurement on conventional muffler shown in FIG. 20, and FIG. 18 is that of the muffler related with this invention. In the conventional muffler, frequency range where the sound pressure is very large exists periodically and the generation of resonance phenomena is recognized. In contrary to this, the sound pressure is low in the whole range by the muffler of the present invention shown in FIG. 18, resonance phenomenon cannot be recognized, and the muffling of the sound is effectively performed. In this measurement, noise level of the muffler of the present invention was 6db lower than that of the conventional mufflers.

As stated above, the muffler of the present invention is based on a quite different theory with that of the conventional muffler, and the gas flow from the exhaust duct pipe to the tail pipe is formed to almost a straight line without any reflection, therefore, the exhaust resistance is very small, and can muffle the sound efficiently. Moreover the structure is very simple, with less chance of failure, excellent in durability, and is helpful for the energy saving and prevention of noise pollution.

What is claimed is:

1. A muffler comprising:

a muffler body;

an exhaust duct pipe connected to one end of said muffler body;

a tail pipe connected to another end of said muffler body;

at least one intermediate duct pipe installed inside said muffler body colinear with said exhaust and tail pipes, whereby exhaust gas from said exhaust duct pipe can pass through said intermediate duct pipe in a substantially straight line without reflecting; and a resonance prevention body comprising an open ended inner pipe within at least one of said muffler body, said exhaust duct pipe and said tail pipe to form a main flow route and cooperates with said at least one of said muffler body, said exhaust duct pipe and said tail pipe to further form therein a by-pass flow route, said inner pipe having flow resistance means to provide flow resistance for gasses in said by-pass flow route.

2. A muffler comprising:

a muffler body;

an exhaust duct pipe connected to one end of said muffler body;

a tail pipe connected to another end of said muffler body;

at least one intermediate duct pipe installed inside said muffler body colinear with said exhaust and tail pipes, whereby exhaust gas from said exhaust duct pipe can pass through said intermediate duct pipe in a substantially straight line without reflecting; and a resonance prevention body comprising a by-pass pipe having ends connected to at least one of said exhaust duct and tail pipes at positions spaced along a length of said at least one of said exhaust duct and tail pipes, said by-pass pipe having flow resistance means to provide a flow resisting by-pass flow route parallel to a main flow route in said at least one of said exhaust duct and tail pipes.

3. A muffler comprising:

a muffler body;

an exhaust duct pipe connected to one end of said muffler body;

a tail pipe connected to another end of said muffler body;

at least one intermediate duct pipe installed inside said muffler body colinear with said exhaust and tail pipes, whereby exhaust gas from said exhaust duct pipe can pass through said intermediate duct pipe in a substantially straight line without reflecting; and a resonance prevention body comprising a by-pass pipe having one end connected to a main flow route in at least one of said exhaust and tail pipes and having another sealed end, said by-pass pipe having gas reflecting means.

4. The muffler of claim 1 or 2 or 3, including means for dividing said muffler body into a plurality of axially separated chambers.

* * * * *